United States Patent [19]

Almosnino et al.

[11] 4,037,764

[45] July 26, 1977

[54] CHILD CARRIER

[76] Inventors: Emanuel Almosnino; Susan Draisin Almosnino, both of 186 Ives St., Providence, R.I. 02906

[21] Appl. No.: 608,691

[22] Filed: Aug. 28, 1975

[51] Int. Cl.[2] ..... A63G 9/00; A47D 13/02

[52] U.S. Cl. ..... 224/6; 224/8 R; 272/85; 297/385

[58] Field of Search ..... 224/6, 5 W, 8 R; 24/DIG. 18; 2/DIG. 6; 272/85; 297/275, 385, DIG. 6

[56] References Cited

U.S. PATENT DOCUMENTS

| | | | |
|---|---|---|---|
| 1,605,473 | 11/1926 | Schneidau | 224/6 |
| 2,852,066 | 9/1958 | Hawkins | 297/275 |
| 3,019,053 | 1/1962 | Lambert | 297/275 |
| 3,034,132 | 5/1962 | Landsberger et al. | 2/DIG. 6 |
| 3,241,881 | 3/1966 | Carnahan et al. | 297/385 |
| 3,499,681 | 3/1970 | Benitez, Jr. | 297/385 |

FOREIGN PATENT DOCUMENTS

| | | | |
|---|---|---|---|
| 247,491 | 10/1963 | Australia | 297/385 |
| 1,545,820 | 9/1967 | France | 224/6 |
| 863,713 | 1/1941 | France | 224/6 |
| 430,494 | 8/1967 | Switzerland | 2/DIG. 6 |
| 895,106 | 12/1960 | United Kingdom | 297/275 |
| 403,153 | 12/1933 | United Kingdom | 224/6 |

OTHER PUBLICATIONS

Canadian Velcro Ltd., Los Angeles, Calif. Police Dept. Uniforms, P.N.R. No. 1057 - 10/6/69.

*Primary Examiner*—Robert J. Spar
*Assistant Examiner*—Carl Rowold

[57] ABSTRACT

A child carrier adapted to be conveniently borne by an adult and readily adjustable to conform to the body of any child. The carrier is fabricated from a piece of flat, flexible material contoured to define a back section provided with a pair of outstretched wings and joined by a Venturi-shaped crotch section to a flap section. In assembling the carrier, the child's body is placed with his back resting on the back section, the flap section being then folded over the abdomen, with the child's legs extended through the openings formed by the crotch section, thereby creating a diaper-like pouch. The pouch is completed by overlapping the wings on the folded-over flap section and fastening the wings thereto at positions determined by the dimensions of the child's body, whereby the child is snugly held. The loaded pouch thus formed is mounted on the back or chest of the bearer by means of a pair of straps attached to the back section and loopable over the bearer's shoulders, the free ends of the straps being connectable to each other.

7 Claims, 9 Drawing Figures

CHILD CARRIER

BACKGROUND OF THE INVENTION

This invention relates generally to child carriers, and more particularly to a carrier formed from a single piece of flexible material having foldable sections to define a diaper-like pouch conforming to the body of the child held therein, the carrier being convertible into a swing.

Carriers for young children are available in various forms, the carriers being designed either to support a child against the back of the parent or other bearer in the manner of a knapsack or a backpack, or against the chest of the bearer, the latter arrangement being desirable when it is necessary to lend support to an infant's head.

Thus in the Thompson U.S. Pat. No. 3,197,100, the carrier is of the backpack type, and the child is locked therein by strap hooks. The Hanson U.S. Pat. No. 3,780,919 discloses a carrier in the form of a fabric pouch having leg openings therein, a somewhat similar arrangement being shown in the Higuchi U.S. Pat. No. 3,331,540.

One difficulty experienced with many existing types of child carriers is that its load capacity is more or less predetermined, and while a given carrier may be adapted to receive an infant weighing, say 12 pounds, it is incapable of holding an outer child of substantially greater weight. Or if the carrier is capable of accommodating an older child, it is too loose for securely holding an infant.

Among the factors which are important in carrier design are security, comfort and load balance, these factors being interdependent. Thus a loose-fitting carrier may hold a child comfortably, but in the absence of a secure fit, the carrier may be hazardous. In other cases, a carrier may hold the child securely, but the manner in which it is strapped to the bearer's body may result in poor weight distribution, with the loadcutting into the shoulders of the bearer or pressing hard against the back of the neck. In carrier design, one must take into account that the load bearer requires freedom of movement, and a carrier which interference with this freedom, however well it holds the child, is unacceptable.

While carriers of the prior art type have satisfied some, if not all, of the above criteria, they have generally succeeded in doing so for a given child at a particular stage in its development. But since carriers are useful from early infancy to the stage where the child may be classified as a late toddler, in the course of which development the child undergoes significant changes in size and weight, carriers of the type heretofore known have failed to meet these changing requirements. Consequently, it has hitherto been necessary at different stages in the child's development to discard one type of carrier in favor of another. This is not only an expensive procedure but it also dictates a period of adjustment which may be somewhat painful to the child, for having become accustomed to a particular type of carrier, the child is usually slow to accept a modified form.

In some instances, child carriers are designed so that they may be adjusted to accommodate a particular load, and for this purpose the carrier is provided with adjustable belts, buckles and similar expedients, making it possible to fit the carrier to the child. However, such expedients are usually difficult to manipulate and set properly.

Another factor that must be considered in the design of an adjustable carrier is repeatability; that is, the ability of the carrier to be applied and fitted to the child over and over again without impairing the efectiveness and reliability of the components used for this purpose. Since the carrier may be put on and taken off several times a day, a carrier which is incapable of functioning reliably on at least 3,000 to 4,000 occasions—this representing the normal life-time of the carrier—is not acceptable.

SUMMARY OF INVENTION

In view of the foregoing, it is the main object of this invention to provide a child carrier which is easily fitted to the body of a child regardless of his stage of development and with a high degree of repeatability, so that the same carrier may be used from early infancy to the late toddler stage.

More particularly , it is an object of this invention to provide a carrier of the above-type which makes use of relatively little material to provide a light-weight, low-cost carrier.

A significant feature of the invention is that the carrier may be quickly fitted to the child without discomfort, and that the loaded carrier may be easily secured to the bearer's body, these actions being accomplished by the bearer without assistance. Because the adjustable carrier's structure lends itself to a close fit about the child and is adaptable to the body of the bearer, a high order of safety and comfort is realized.

Also an object of the invention is to provide an adjustable child carrier which affords optimum balance and support.

Yet another object of the invention is to provide a child carrier which is convertible into a swing, whereby the child, instead of being strapped to the bearer, is safely suspended from an overhead bar or branch.

Briefly stated, these objects are attained by a carrier fabricated from a piece of flat, flexible material such as canvas, contoured to define a back section having a pair of outstretched wings and joined by a Venturi-shaped crotch section to a flap section.

In assembling the carrier, the child's body is placed with his back resting on the back section, the flap section then being folded over the abdomen, with the child's legs extending through the opening formed by the crotch section, thereby creating a diaper-like pouch which is completed by overlapping the wings on the folded-over flap section and fastening the wings thereto at positions determined by the dimensions of the child's body, whereby the child is snugly held within the pouch. The wing connections are effected by a pressure-responsive fabric fastener whose male elements are secured to the wings and whose female elements are secured to the exposed surface of the foldled-over flap section.

The loaded pouch thus formed is mounted on the back or chest of the bearer by means of a pair of straps attached to the back section and loopable over the bearer's shoulders, the free ends of the straps being connectable to each other.

OUTLINE OF THE DRAWINGS

For a better understanding of the invention as well as other objects and further features thereof, reference is made to the following detailed description to be read in conjunction with the accompanying drawings wherein:

FIG. 6 illustrates the assembled carrier borne in front of a bearer;

DESCRIPTION OF INVENTION

The Carrier Assembly

Figure 1:
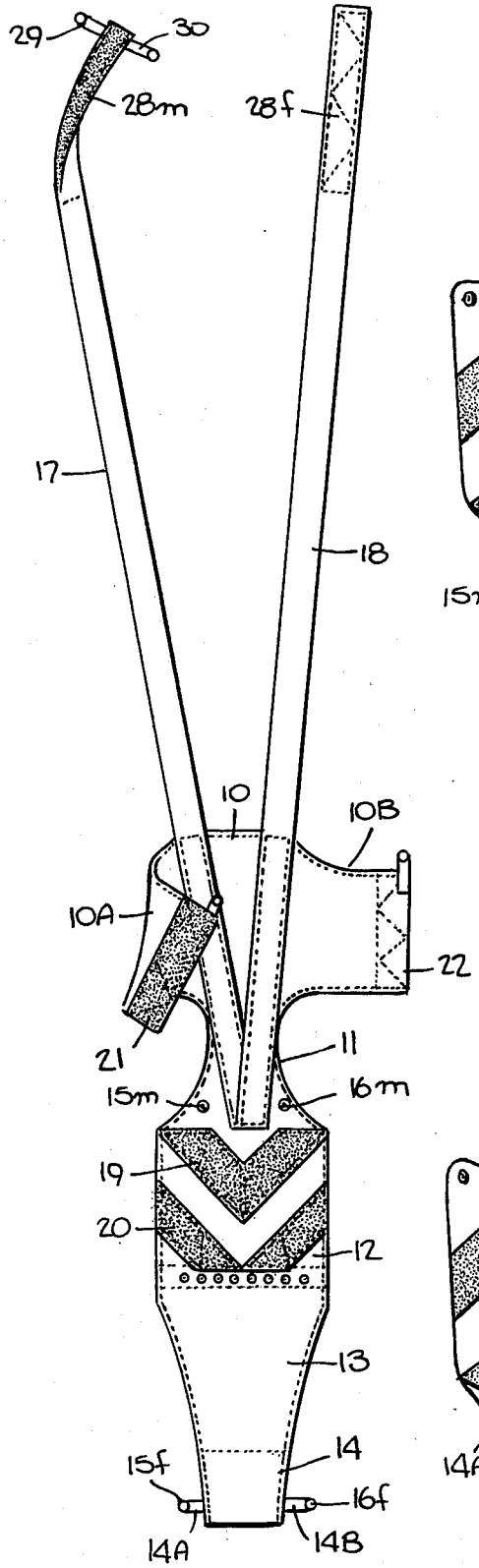
FIG. 1 is a rear face view of a child carrier in accordance with the invention, as seen prior to assembly.

Referring now to FIG. 1, there is shown a one-piece carrier in accordance with the invention, as seen from the rear face of the piece in its unfolded or unassembled form. The carrier is fabricated of canvas, simulated leather, or other suitable flexible material which is of high strength and washable.

The carrier piece is contoured to define a generally-rectangular back section 10 having a pair of outstretched wings 10A and 10B, the back section 10 being joined by a Venturi-shaped crotch section 11 to a generally-rectangular flap section 12. Extending from the flap section 12 is a swing section 13 which tapers and terminates in a closed loop 14, through which one may pass a strap to support the carrier from an overhead bar or branch, as will later be explained. Stitched or otherwise secured to the crotch and back sections of the piece in a V-formation and extending therefrom are a pair of straps 17 and 18.

Figure 2:
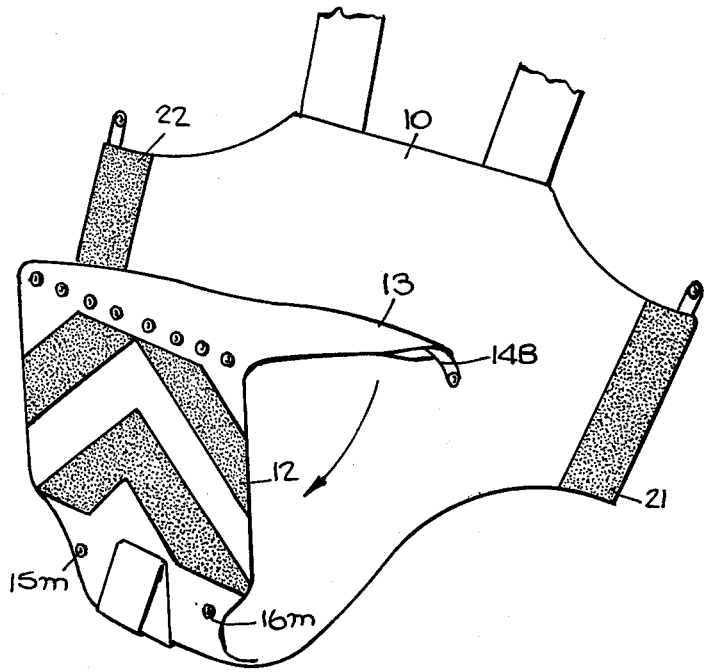
FIG. 2 shows, in perspective, the carrier at one point in its assembly.
Figure 3:
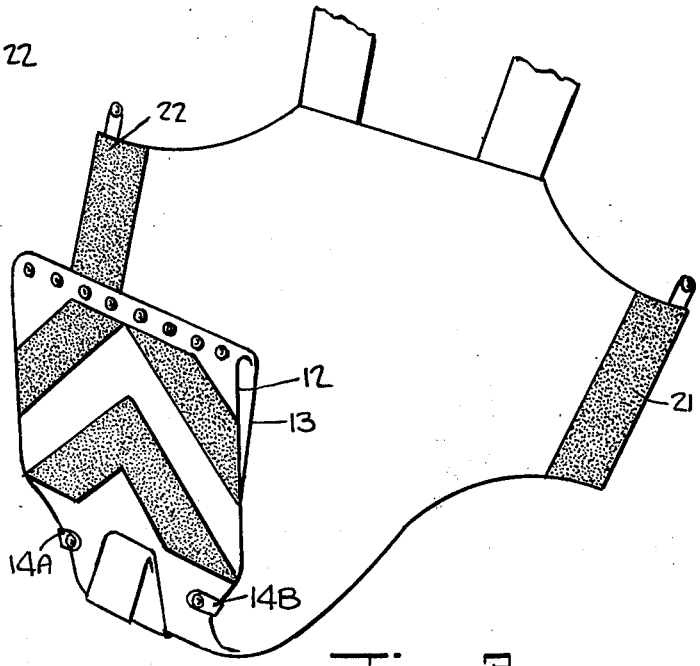
FIG. 3 shows, in perspective, the carrier at a later point in its assembly.

When the carrier is to be borne on the back or chest of a bearer, the swing section 13 is then used to reinforce the flap section 12. This is done, as shown in FIG. 2, by folding swing section 13 behind flap section 12 and latching it thereto by means of tabs 14A and 14B. These tabs extend outwardly from loop 14 and terminate in the female elements **15*f* and 16*f* of a pair of snap fasteners, which female elements are coupled to complementary male elements 15m and 16m secured to the crotch section. This imparts to the flap section, as shown in FIG. 3**, a double thickness, the swing section then acting as a padding therefor.

Stitched or otherwise secured to the rear face of flap section 12 in a double-V or chevron formation are the female members 19 and 20 of a detachable pressure-responsive fabric fastener of the so-called "Velcro" type. The complementary male members of this fastener are in the form of rectangular strips 21 and 22 which are secured to the margins of wings 10a and 10B.

The female members of this type of fabric fastener are formed by randomly-dispersed fibers creating a fuzzy surface, whereas the male members are formed by a relatively-uniform pile of stiff hook-shaped fibers which penetrate and snag onto the fuzzy female surface. The nature of this fabric fastener is such that when the male members are in engagement with the female members, they cannot be laterally dislodged, disengagement being effected by peeling the male members off the female members.

Figure 4:
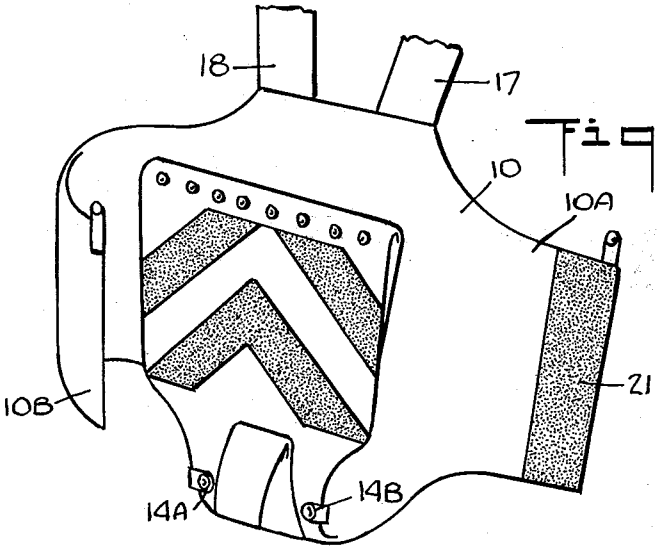
FIG. 4 shows, in perspective, the carrier at a still later point in its assembly.
Figure 5:
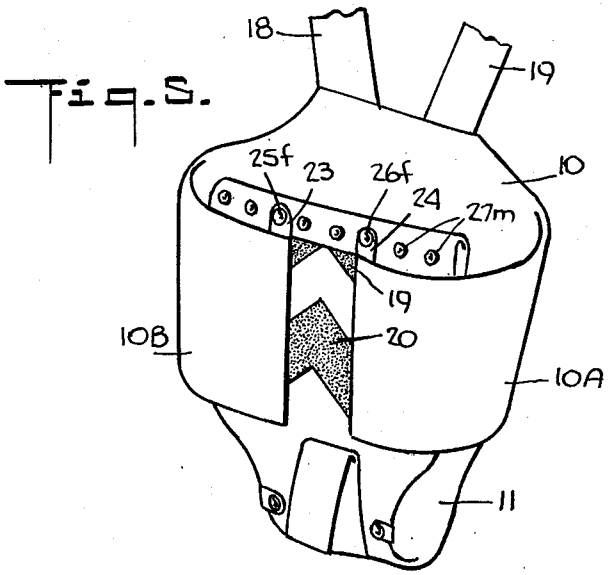
FIG. 5 shows, in perspective, the carrier at its final point of assembly.

To assemble the carrier, the flap section 12 is folded over the upper section 10, as shown in FIG. 4, and wings 10A and 10B are caused to overlap flap section 12, whereby male members 21 and 22 of the fabric fastener may then be pressed down into engagement with the female members to define, as shown in FIG. 5, a diaper-like pouch in which the folded-over crotch section 11 has openings to accommodate the legs of the child.

It will be evident that the capacity of the pouch is determined by the positions at which engagement is effected between the male and female members of the fabric fastener, and that the greater the spacing between the ends of the folded-over wings, the larger the pouch capacity. This adjustment in capacity is carried out with the child in place, thereby specifically tailoring the pouch to the child.

In practice, the carrier piece, in its flat state, is laid down on a table or other level surface, with the "Velcro" side of flap section 12 facing down. The child is then placed with his back section 10 and with his hips just above the junction of back section 10 and crotch section 11. Flap section 12 is then folded over the child's abdomen, as a result of which Velcro members 19 and 20 thereon face up.

Wings 10A and 10B are then folded over the flap section and pressed down to effect engagement of male members 21 and 22 with female members 19 and 20 of the Velcro fastener. To bring about a snug fit, the child is slightly turned first to one side and then to the other, each wing being pressed and smoothed against the child before pressure is applied to the fastener to assure an even and secure fit.

Once the child is in place and fitted within the diaper-like pouch, and the wings occupy positions ensuring a snug fit, these positions are locked by means of tabs 23 and 24 secured to the corners of the wings. The tabs are provided with the female elements **25*f* and 26*f* or snap fasteners. These female elements are snapped onto complementary male elements 27*m* in a row thereof attached to flap section 12 at its junction with swing section 13**, so as to prevent peeling off of the fabric fastener.

Thus the pouch is expandable, and whatever position is assumed by the wings to accommodate a child of a particular size, this wing position is maintained by the combined actions of the Velcro and snap fasteners, providing double-security. On the other hand, the nature of these fasteners is such that the carrier may be assembled or disassembled without any difficulty and very quickly.

The chevron configurations of the Velcro female members 19 and 20 on the flap section has the advantage of providing a secure connection with the male members 21 and 22 on the wings, for regardless of where the wings are positioned, the male member on each wing will intersect and connect with the female members eat two spaced points.

Mounting Mode

Figure 7:
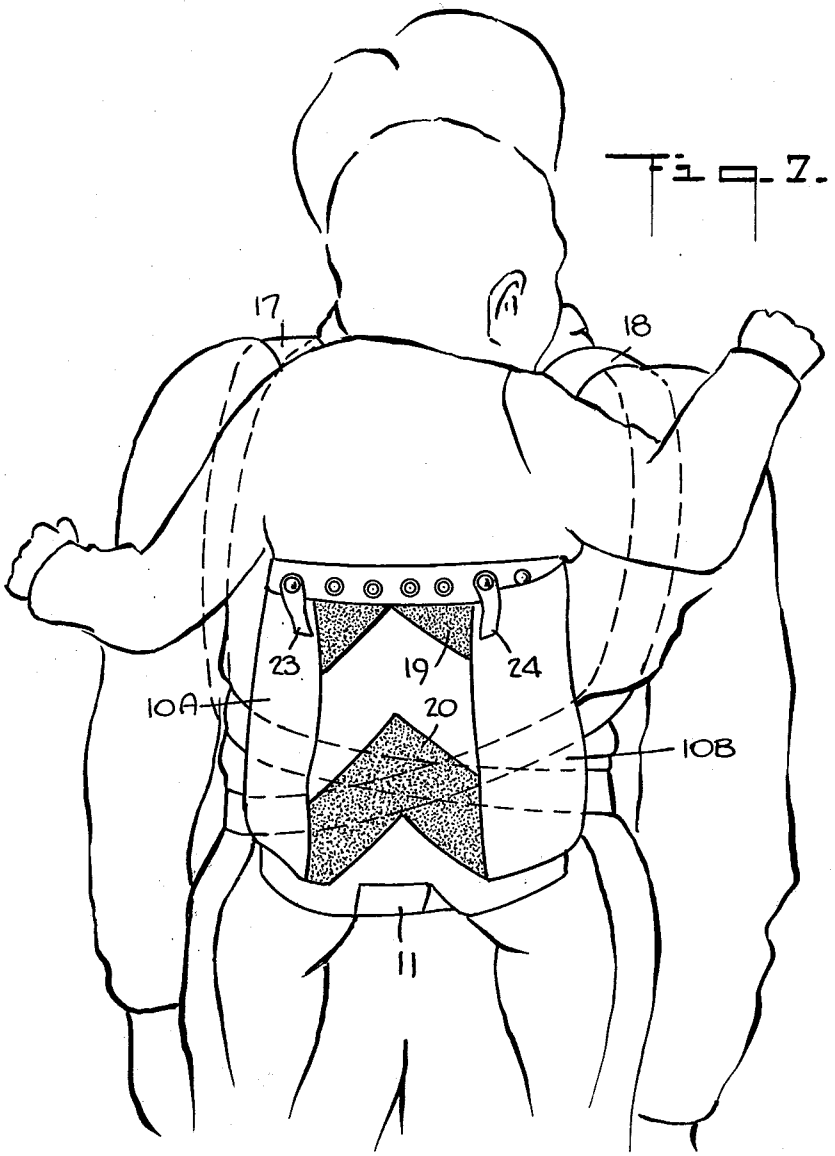
FIG. 7 illustrates the assembled carrier borne on back of a bearer.
Figure 8:
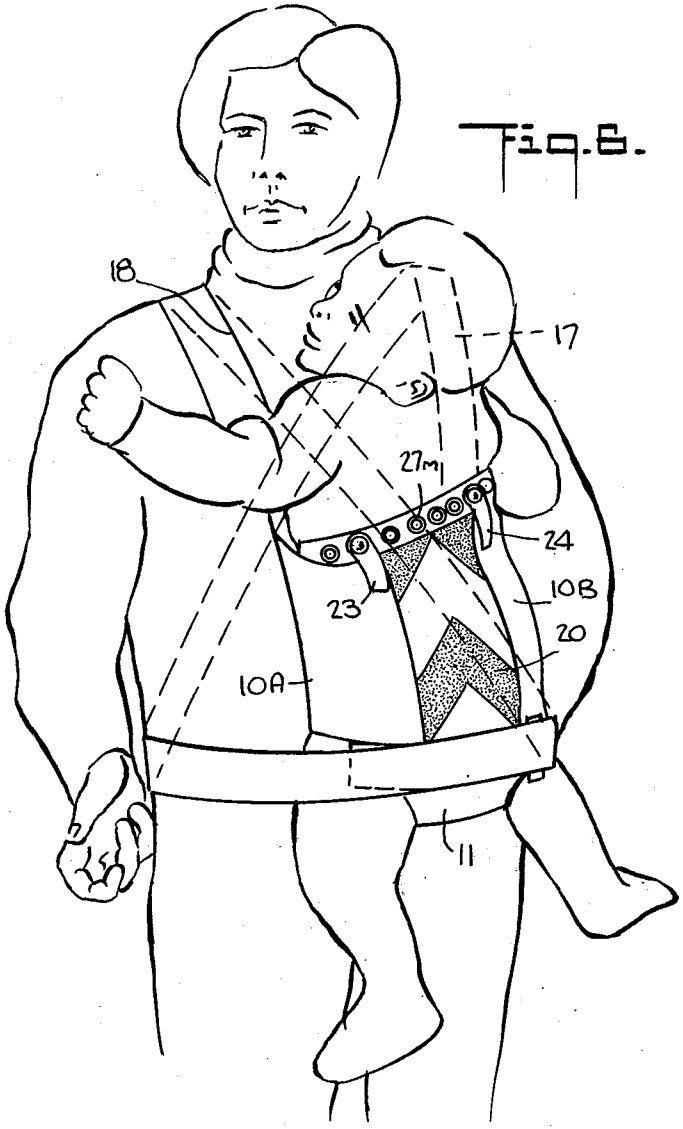

Once the child is snugly held within the carrier, he can be lifted by straps 17 and 18 and held in balance. If the carrier is to be mounted on the back of the bearer, it is swung around to the back and the straps looped over the shoulder. The bearer then pulls the straps down to raise the carrier to a back position in which the weight of the loaded carrier is most comfortably borne. Then, still holding the straps, the bearer brings them around each arm, as shown in FIG. 7, he crosses them in the back and connects the free end of the straps to each other in the front at the waist.

For this purpose, as shown in FIG. 1, strap 18 is provided with a strip-shaped female member **28*f* of a fabric fastener, while strap 17 is provided with a complementary male member 28*m*. Strap 17, at its free end, is also provided with tabs 29 and 30** terminating in the elements of a snap fastener. When these tabs are interconnected, they form a closed loop protectively encircling the joined-together ends of the straps.

When the carrier is borne on the front of the bearer so that the bearer can lend support to the child's head, the child in the carrier is supported with one arm, while with the other arm, the straps are passed over the shoulders onto the back and then crossed over the back and attached in the front either at the waist of the bearer, as shown in FIG. 6, or made to fit under the hips of the child to afford additional support for the load.

Swing Mode

Figure 9:
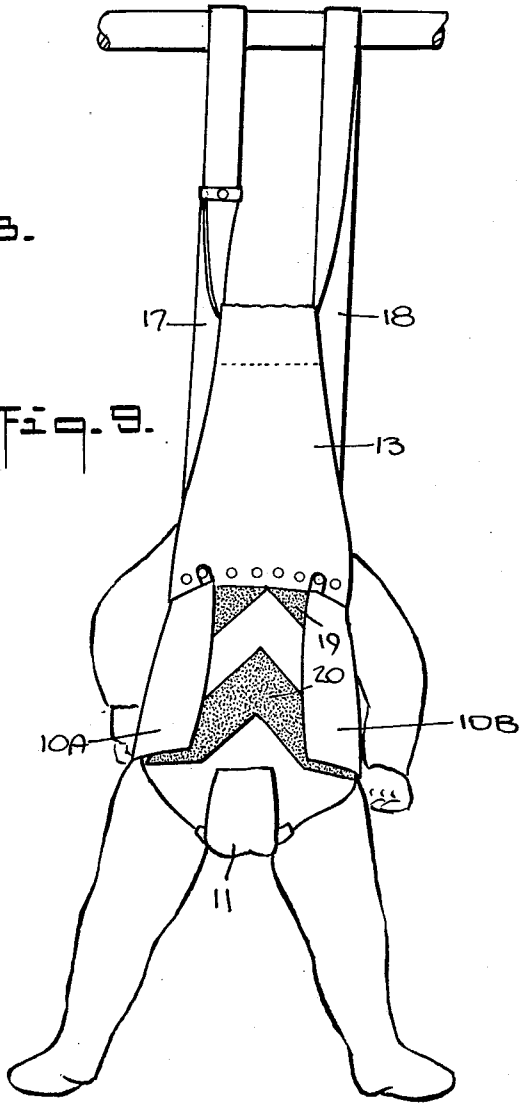
FIG. 9 is a back view of the carrier in the swing mode.
Figure 8:
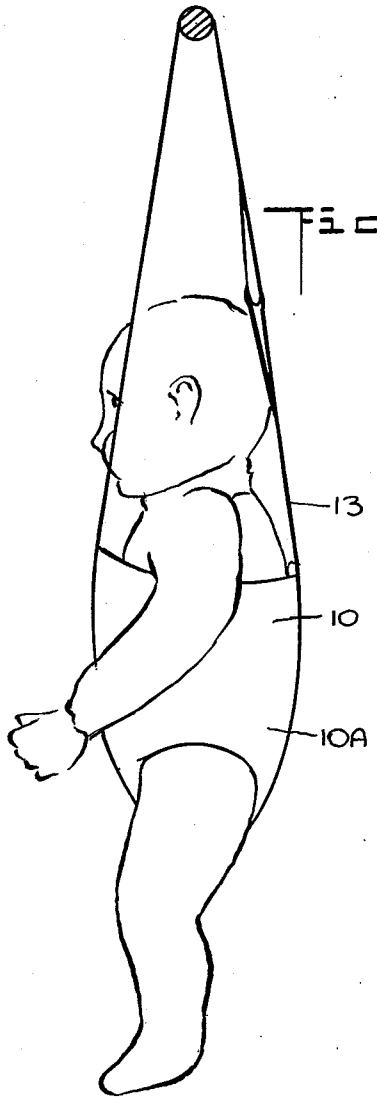
FIG. 8 shows, in side view, the carrier functioning in the swing mode.

To convert the carrier into a swing mode operation, the swing section 13 which in the mounting mode is folded under the back section, is released by detaching the snap fastener tabs 14A and 14B, the swing section then being pulled out, as shown in FIGS. 8 and 9.

The straps are passed over an elevated bar or tree branch, and one strap is extended through loop 14. The Velcro fastener male and female elements at the end of the straps are then joined together. The joined ends are slid back into the loop and the loop put into balance. With this arrangement, a child is able to swing fully without danger of falling.

While there has been shown and described a preferred embodiment of a child carrier in accordance with the invention, it will be appreciated that many changes and modifications may be made therein without, however, departing from the essential spirit thereof.

We claim:

1. A child carrier which may be mounted on the back or front of a bearer, said carrier comprising a flat piece of flexible material contoured to define a back section having a pair of outstretched wings and joined by a Venturi-shaped crotch section to a flap section, the width of the back section with outstretched wings exceeding that of the flap section, the carrier being assembled by placing a child therein with its back resting on the back section, after which the flap is folded over the child's abdomen with the child's legs extending through openings formed by the crotch section, to create a diaper-like pouch, the pouch being completed by overlapping and fastening the wings on the folded-over flap section, said wings being detachably connected to the exposed surface of said folded-over flap section by fabric fasteners formed by male elements secured to the margins of the wings and female elements secured to and extending across the exposed surface of the flap section whereby the size of the pouch may be conformed to the body of the child, a pair of straps attached to the back section and loopable over the shoulders of the bearer, and snap fastener means to latch said wings onto said flap section, said snap fastener means being constituted by female snap elements mounted on the free ends of tabs attached to the corners of said wings and complementary male snap elements mounted in a row across the flap section, whereby said wings may be latched at any selected position across said flap section to prevent the male elements of the fabric fasteners from peeling off.

2. A carrier as set forth in claim1, wherein said piece further includes a swing section extending from said flap section and terminating in a loop whereby when said carrier is to be mounted, said swing section is folded against the flap section to reinforce same, and when said carrier is to be used as a swing, said swing section is extended and one of said straps is passed through said loop.

3. A carrier as set forth in claim 2 wherein said swing section is provided with means to fasten it to said plop section when it is folded thereagainst.

4. A carrier as set forth in claim 1 further including means to detachably fasten the free ends of said straps together.

5. A carrier as set forth in claim 1 wherein said female elements have a chevron configuration and said male elements are formed by strips which intersect the chevron.

6. A carrier as set forth in claim 5 wherein said male elements are constituted by a pile of hook-shaped stiff fibers and said female elements by randomly-dispersed fibers.

7. A carrier as set forth in claim 1, further including fabric fastener means to interconnect the free ends of the straps, the length of the straps being such that when the carrier is mounted on the back of a bearer, the straps may be looped over the shoulders and then crossed over the back and brought to the front at the waist where the straps are interconnected.

* * * * *

UNITED STATES PATENT OFFICE

CERTIFICATE OF CORRECTION

Patent No. 4,037,764 Dated July 26, 1977

Inventor(s) Emanuel Almosnino, Susan Draisin Almosnino

It is certified that error appears in the above-identified patent and that said Letters Patent are hereby corrected as shown below:

Column 1, line 45 "interference" should have read -- interferes --

Column 2, line 6 "efectiveness" should have read -- effectiveness --

Column 2, line 58 "foldled" should have read -- folded --

Column 4, line 23 before "section" -- resting on back -- should have been inserted Column 4, line 59 "eat" should have read -- at --

Claim 3, line 2 "plop" should have read -- flap --

Signed and Sealed this

First Day of November 1977

[SEAL]

Attest:

RUTH C. MASON
Attesting Officer

LUTRELLE F. PARKER
Acting Commissioner of Patents and Trademarks